US009578929B2

(12) United States Patent
Hung

(10) Patent No.: US 9,578,929 B2
(45) Date of Patent: Feb. 28, 2017

(54) SAFETY BELT BUCKLE

(71) Applicant: YOKE INDUSTRIAL CORP., Taichung (TW)

(72) Inventor: Wei-Chieh Hung, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 137 days.

(21) Appl. No.: 14/195,039

(22) Filed: Mar. 3, 2014

(65) Prior Publication Data

US 2015/0074958 A1 Mar. 19, 2015

(30) Foreign Application Priority Data

Sep. 18, 2013 (TW) ..... 102133888 A

(51) Int. Cl.
*A44B 11/25* (2006.01)

(52) U.S. Cl.
CPC ..... *A44B 11/2511* (2013.01); *A44B 11/2546* (2013.01); *Y10T 24/45251* (2015.01)

(58) Field of Classification Search
CPC ..... A44B 11/2511; A44B 11/2546; A44B 11/263; A44B 11/26
USPC ..... 24/648, 634, 625, 594.1, 593.1
See application file for complete search history.

(56) References Cited

U.S. PATENT DOCUMENTS 3,168,770 A * 2/1965 John, Jr. ..... A44B 11/2519 24/648
3,201,840 A * 8/1965 Jantzen ..... A44B 11/2519 24/634
3,262,169 A * 7/1966 Jantzen ..... A44B 11/2526 24/196
3,404,439 A * 10/1968 Jones ..... A44B 11/2526 24/603
3,523,342 A * 8/1970 Spires ..... A44B 11/2511 24/632
3,605,210 A * 9/1971 Lohr ..... A44B 11/2511 24/635
3,648,333 A * 3/1972 Stoffel ..... A44B 11/2511 24/635
3,649,999 A * 3/1972 Stoffel ..... A44B 11/2511 24/635
3,807,000 A * 4/1974 Weman ..... A44B 11/2511 24/655
4,068,354 A * 1/1978 Loomba ..... A44B 11/2523 24/641

(Continued)

*Primary Examiner* — Robert J Sandy
*Assistant Examiner* — Jason W San
(74) *Attorney, Agent, or Firm* — Ming Chow; Sinorica, LLC

(57) ABSTRACT

A safety belt buckle, which includes a buckle member, a hook, a stop member, a latch member and a release button, wherein the latch member has a tongue plate which enters a chamber of the buckle member through a lateral opening of the buckle member, and pushes the stop member to a predetermined position; when the stop member stays at the predetermined position, the hook is restricted by the stop member, and stopped at another predetermined position to engage the tongue plate, which makes the latch member unable to separate from the buckle member. By pushing the release button connected to the stop member, the hook can pivot unrestrictedly, therefore the tongue plate is no longer engaged by the hook, and the latch member and the buckle member can separate from each other.

5 Claims, 5 Drawing Sheets

(56) References Cited

U.S. PATENT DOCUMENTS 4,228,567 A * 10/1980 Ikesue ..... A44B 11/2511 24/642
4,317,263 A * 3/1982 Fohl ..... A44B 11/2511 24/635
4,377,888 A * 3/1983 Ikesue ..... A44B 11/2511 24/637
4,385,424 A * 5/1983 Petersen, III ..... A44B 11/2511 24/633
4,577,378 A * 3/1986 Harenberg ..... A44B 11/2511 24/633
4,642,857 A * 2/1987 Ono ..... A44B 11/2511 24/637
4,766,654 A * 8/1988 Sugimoto ..... A44B 11/2511 24/637
4,949,436 A * 8/1990 Anscher ..... A44B 11/263 24/616
5,138,751 A * 8/1992 Shima ..... A44B 11/2511 24/637
5,142,748 A * 9/1992 Anthony ..... A44B 11/2511 24/579.11
5,267,377 A * 12/1993 Gillis ..... A44B 11/2511 24/633
5,269,051 A * 12/1993 McFalls ..... A44B 11/2511 24/632
5,283,933 A * 2/1994 Wiseman ..... A44B 11/2511 24/579.11
5,406,681 A * 4/1995 Olson ..... A44B 11/2511 24/579.11
5,419,020 A * 5/1995 Murai ..... A44B 11/266 24/625
5,465,472 A * 11/1995 Matoba ..... A44B 11/266 24/616
5,606,783 A * 3/1997 Gillis ..... A44B 11/2511 24/628
5,709,014 A * 1/1998 Takahashi ..... A44B 11/2511 24/614
5,832,573 A * 11/1998 Howell ..... A44B 11/2526 24/616
5,857,247 A * 1/1999 Warrick ..... B64D 17/32 24/603
5,979,026 A * 11/1999 Anthony ..... A44B 11/2511 24/633
6,170,133 B1 * 1/2001 Uehara ..... A44B 11/2511 24/614
6,205,629 B1 * 3/2001 Becker ..... A44B 11/2523 24/303
6,560,830 B1 * 5/2003 Chi ..... A44B 11/266 24/616
6,668,434 B2 * 12/2003 Casebolt ..... A44B 11/253 24/265 BC
6,965,231 B1 * 11/2005 Cinoglu ..... A61B 5/0555 324/300
7,089,633 B2 * 8/2006 Liu ..... A44B 11/266 24/615
7,114,225 B2 * 10/2006 Casebolt ..... A44B 11/253 24/265 BC
7,275,613 B2 * 10/2007 Park ..... B60R 22/321 180/270
7,350,277 B1 * 4/2008 Canfield ..... A44B 11/253 24/634
7,373,701 B2 * 5/2008 Coulombe ..... A44B 11/253 24/171
8,176,605 B2 * 5/2012 Mok ..... A44B 11/266 24/613
8,181,319 B2 * 5/2012 Johnson ..... A44B 11/253 182/3
8,281,464 B2 * 10/2012 Shen ..... A44B 11/266 24/614
8,561,268 B2 * 10/2013 Hortnagl ..... A44B 11/2592 24/625
8,572,820 B2 * 11/2013 Richards ..... A44B 11/2519 24/634
8,950,780 B2 * 2/2015 Betz ..... A44B 11/2515 24/633
2002/0184742 A1 * 12/2002 Casebolt ..... A44B 11/253 24/634
2006/0048350 A1 * 3/2006 Coulombe ..... A44B 11/253 24/634
2006/0048351 A1 * 3/2006 Casebolt ..... A44B 11/253 24/634
2009/0013510 A1 * 1/2009 Liang ..... A44B 11/266 24/648
2009/0100652 A1 * 4/2009 Mok ..... A44B 11/266 24/625
2010/0263176 A1 * 10/2010 Lee ..... A44B 11/2573 24/593.1
2010/0314930 A1 * 12/2010 Akaike ..... A44B 11/2523 297/468
2012/0124790 A1 * 5/2012 Richards ..... A44B 11/2519 24/593.1
2013/0328378 A1 * 12/2013 Merrick ..... B60R 22/18 297/483
2014/0082902 A1 * 3/2014 Hortnagl ..... A44B 11/10 24/664

* cited by examiner

SAFETY BELT BUCKLE

The current application claims a foreign priority to the patent application of Taiwan No. 102133888 filed on Sep. 18, 2013.

BACKGROUND OF THE INVENTION

1. Technical Field

The present invention relates generally to a safety belt, and more particularly to a safety belt buckle.

2. Description of Related Art

Safety belts are widely applied in various equipment, such as vehicles, airplanes, boats, harnesses, and some rides in amusement parks, which provide a good protection of life. For example, while a car accident is happening, the car will suddenly stop or change the direction, and the people in the car will be forced to move in the original direction because of inertia force. In such circumstances, safety belt may reduce a death or serious injury by preventing the second impact in the car.

The conventional safety belt can be unbuckled with one hand, and even a kid may unbuckle the safety belt by himself/herself. There are risks that the safety belt may be unbuckled unexpectedly.

BRIEF SUMMARY OF THE INVENTION

In view of the above, the primary objective of the present invention is to provide safety belt buckle, which may prevent the safety belt from being unbuckled unexpectedly.

The present invention provides a safety belt buckle, which includes a buckle member, a hook, a stop member, a latch member, and a release button, wherein the buckle member has a chamber therein and a lateral opening on a side, wherein the lateral opening is communicated with the chamber; the hook is provided in the chamber of the buckle member to be moved between a first position and a second position, wherein the hook stays at the first position under normal condition, and the hook could be moved along a moving trace between the first position and the second position; the stop member is provided in the chamber of the buckle member to be moved between a third position and a fourth position, wherein the stop member stays at the third position under normal condition, and when the stop member is moved to the fourth position, the stop member is on the moving trace of the hook to stop the hook from being moved to the second position from the first position; the latch member has a tongue plate to be detachably inserted into the chamber of the buckle member through the lateral opening, wherein when the tongue plate enters the chamber of the buckle member, the tongue plate engages the hook and moves the stop member to the fourth position from the third position to hold the hook at the first position; the release button is provided on the buckle member, wherein the release button moves the stop member to the third position from the fourth position when the release button is pushed.

With such design, it may ensure that the latch member will not be separated from the buckle member unexpectedly, and one can only do so by pushing the release button and moving the hook at the same time, which meets higher security requirement.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
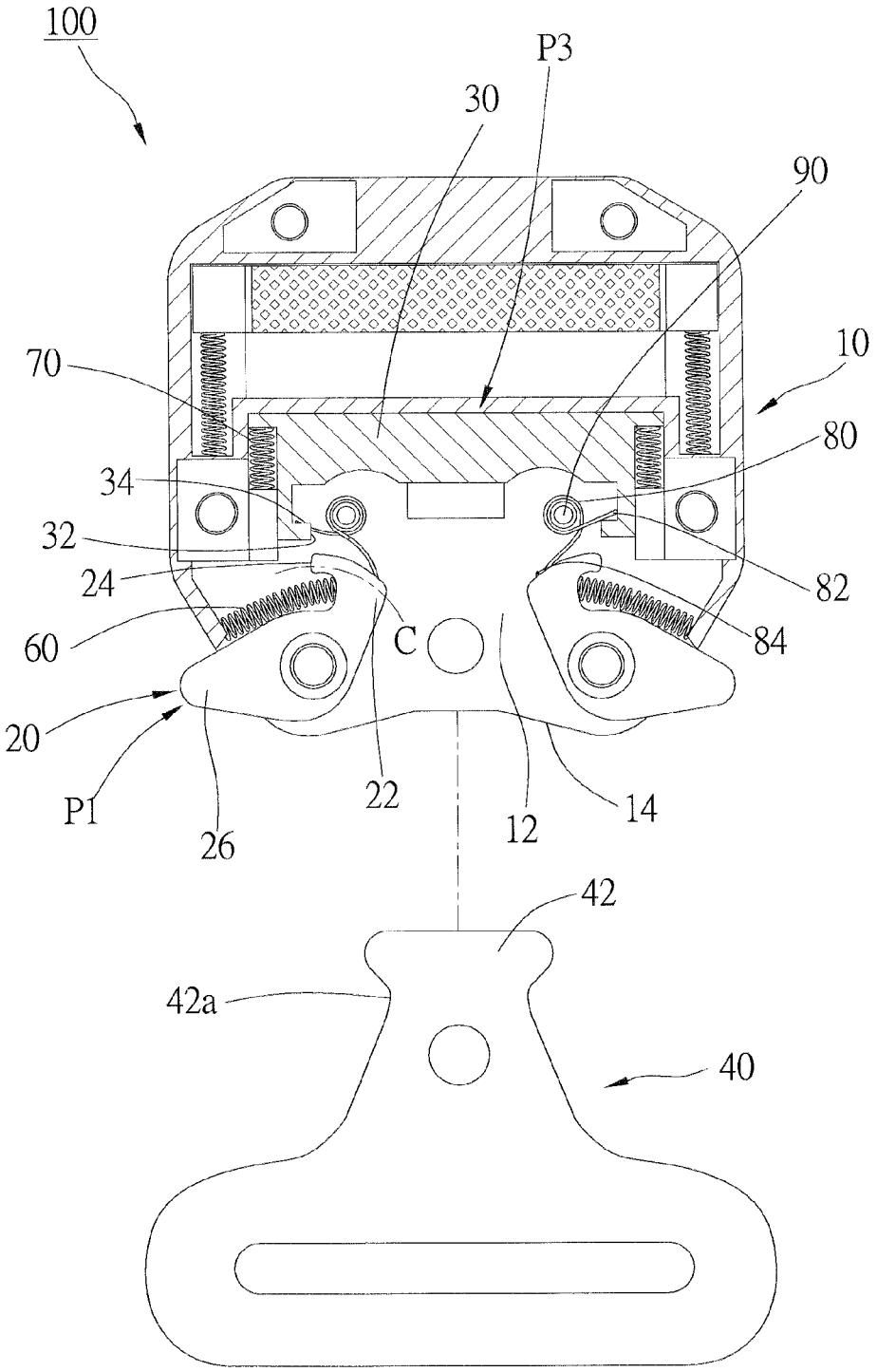
FIG. 1 is a sectional view of a preferred embodiment of the present invention, showing the disengaged latch member and buckle member.

As shown in FIG. 1 to FIG. 5, a safety belt buckle 100 of the preferred embodiment of the present invention includes a buckle member 10, two hooks 20, a stop member 30, a latch member 40, a release button 50, two first elastic members 60, two second elastic members 70, and two transmission members 80. The transmission members 80 are two torsional springs in the present embodiment. The buckle member 10 has a chamber 12 therein and a lateral opening 14 on a side communicated with the chamber 12. The latch member 40 has a tongue plate 42, which may enter the chamber 12 through the lateral opening 14.

Figure 5:
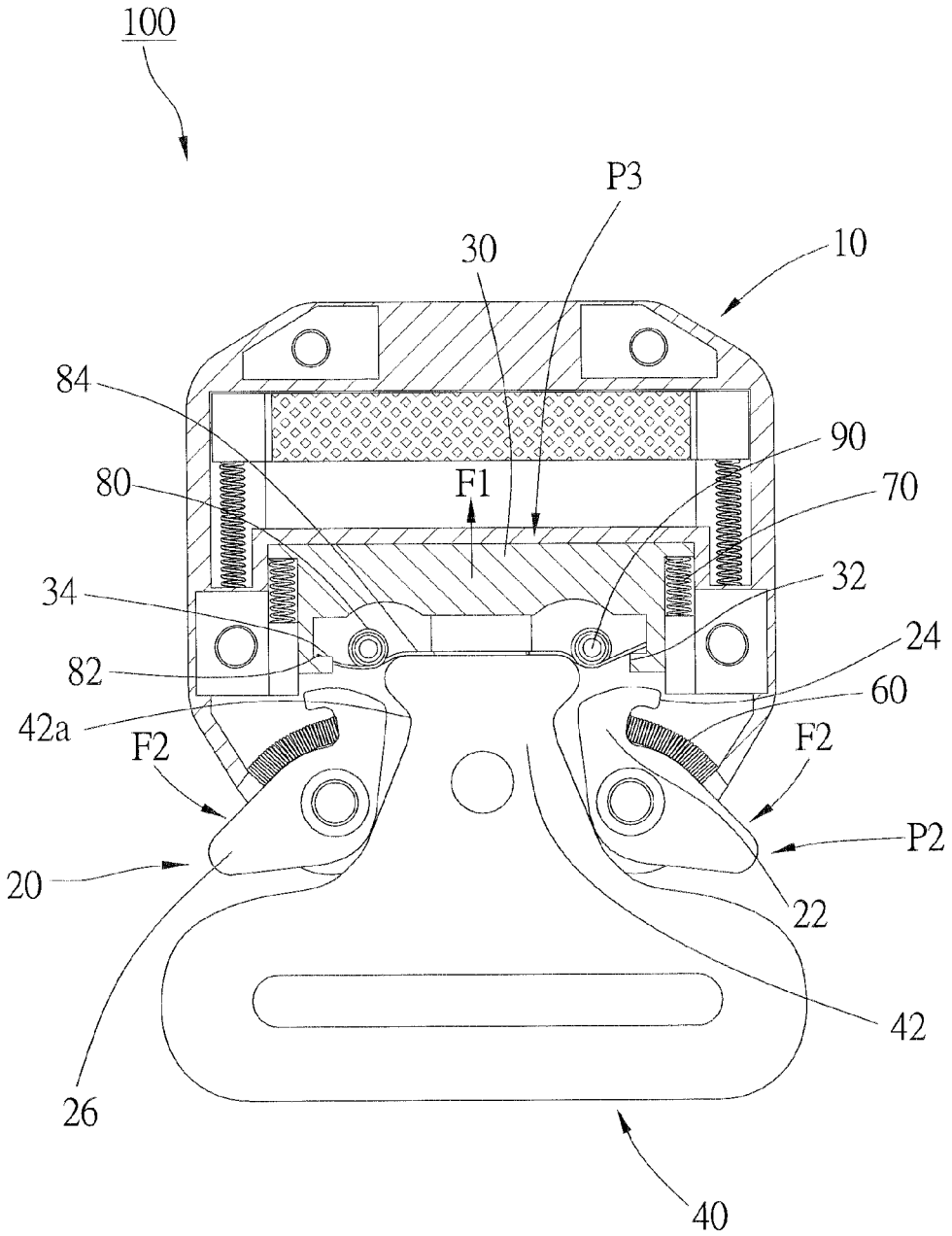
FIG. 5 is a sectional view of the preferred embodiment of the present invention, showing the moving directions of the stop member and the hooks while the latch member is disengaging.

In order to keep the engagement of the latch member 40 and the buckle member 10, the hooks 20 are provided in the chamber 12 of the buckle member 10. Each hook 20 has a hooking portion 22 at a distal end, and is pivoted on the buckle member 10 to pivot between a first position P1 (FIG. 1) and a second position P2 (FIG. 5). The tongue plate 42 of the latch member 40 has a neck portion, which has two recesses 42*a* at opposite sides. The hooking portions 22 engage the recesses 42*a* of the tongue plate 42 respectively when the hooks 20 are at the first positions P1. The first elastic members 60 are received in the chamber 12 of the buckle member 10 respectively to urge the hooks 20 to the first positions P1. Therefore, the hooks 20 are located at the first positions P1 under a normal condition. The first elastic members 60 may ensure the hooks 20 engaged with the latch member 40.

Figure 2:
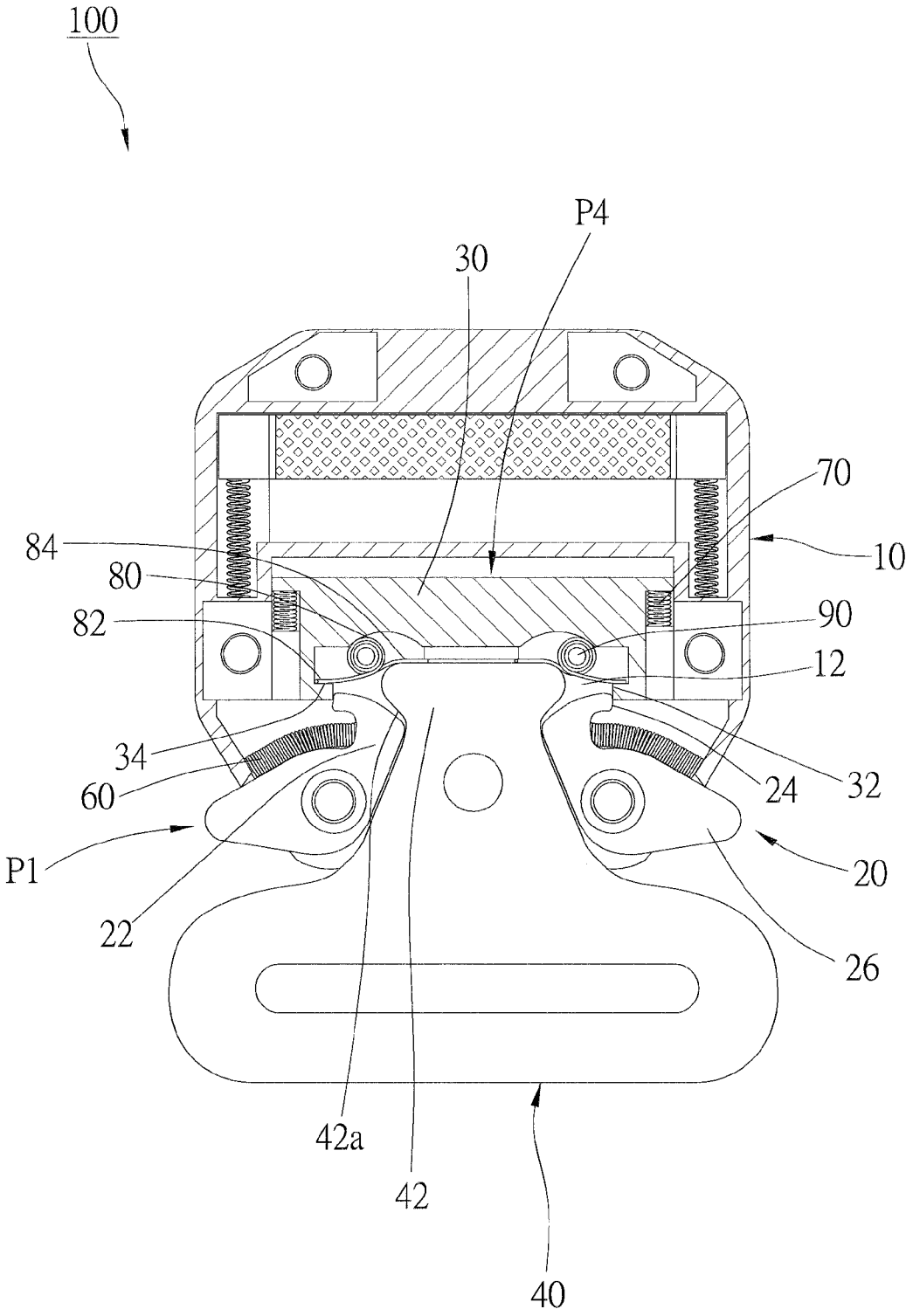
FIG. 2 is a sectional view of the preferred embodiment of the present invention, showing the engaged latch member and buckle member.
Figure 3:
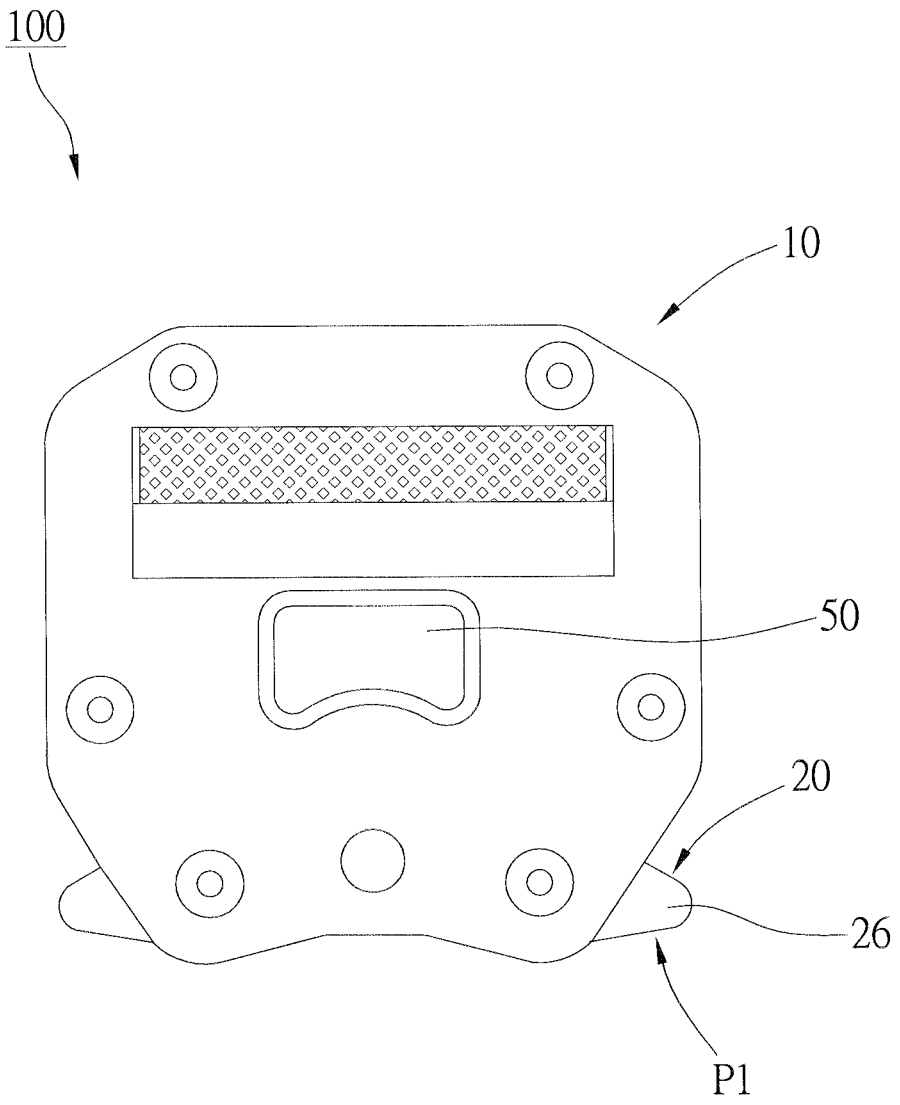
FIG. 3 is a perspective view of the buckle member of the preferred embodiment of the present invention.
Figure 4:
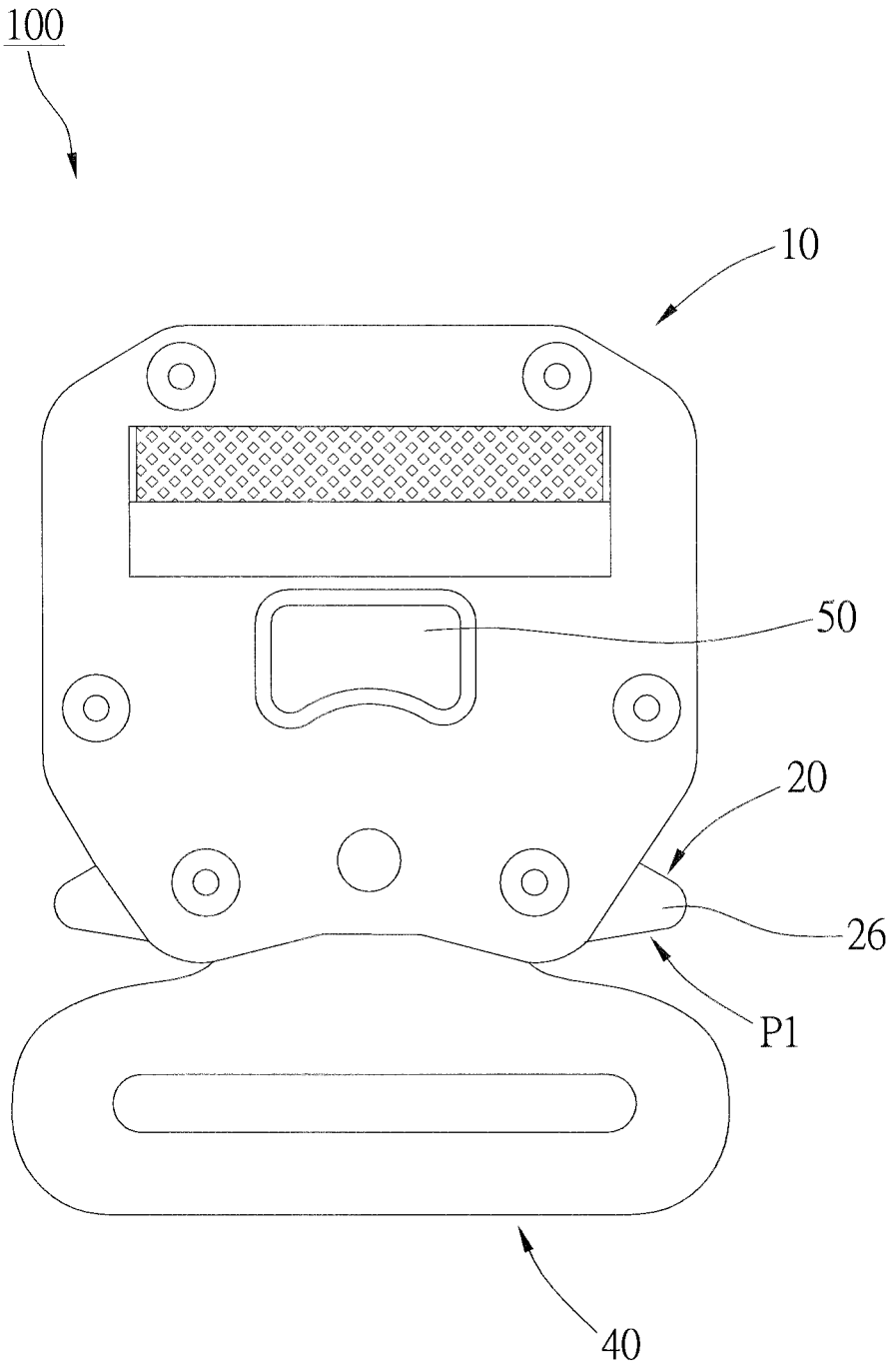
FIG. 4 is a perspective view of the preferred embodiment of the present invention, showing the engaged latch member and buckle member.

The stop member 30 is provided in the chamber 12 as well, and is moved between a third position P3 (FIG. 5) and a fourth position P4 (FIG. 2). The second elastic members 70 is provided in the chamber 12 to urge the stop member 30 to the third position P3, and therefore the stop member 30 is located at the third position P3 under a normal condition. The stop member 30 has two stop faces 32 at opposite sides.

Each hook 20 has an end face 24, and the end face 24 moves along a curved moving trace C (the dot line in FIG. 1) while the hook 20 is pivoting between the first position P1 and the second position P2. The torsional springs (transmission members) 80 fit to posts 90 in the buckle member 10. Each torsional spring 80 has a first end 82 and a second end 84. Each first end 82 presses against a contact face 34 of the stop member 30. The tongue plate 42 of the latch member 40 touches the second end 84 of each torsional spring 80 to move the stop member 30 to the fourth position P4 from the third position P3 when the tongue plate 42 of the latch member 40 enters the chamber 12 through the lateral opening 14. Specifically, the tongue plate of the latch member 40 moves in a direction, which is opposite to that of the stop member 30 while the tongue plate 42 is moving the stop member 30 through the torsional springs 80. The stop faces 32 of the stop member 30 are on the moving trace C and against the end faces 24 of the hooks 20 when the stop member 30 is at the fourth position P4. At this time, the hooks 20 are restricted from pivoting to the second positions P2 from the first positions P1. In other words, the hooks 20 will be held in the first positions P1 while the stop member 30 is moved to the fourth position P4, therefore the latch member 40 is secured to be engaged with the buckle 10 because of the engagement of the hooking portions 22 of the hooks 20 and the recesses 42*a* of the tongue plate 42.

It is noted that the tongue plate 42 moves the stop member 30 to the fourth position P4 through the transmission members 80. In practice, except for the torsional springs, the transmission member 80 could be any equivalent device which moves the stop member 30 to the fourth position P4 from the third position P3 while the tongue plate 42 of the latch member 40 is entering the chamber 12 of the buckle member 10 through the lateral opening 14 to secure tongue plate 42 of the latch member 40 in the chamber 12 of the buckle member 10.

The release button 50 is provided on the buckle member 10, and is connected to the stop member 30. The release button 50 is pushed to move the stop member 30 with a first force F1. As a result, the stop member 30 is moved to the third position P3 from the fourth position P4. Each hook 20 has a contact portion 26 opposite to the hooking portion 22, and the contact portion 26 is exposed out of the buckle member 10. The contact portion 26 is exerted by a second force F2 to move the hook 20 to the second position P2 from the first position P1. As shown in FIG. 5, when a user pushes the release button 50 upwards, the first force F1 moves the stop member 30 to the third position P3. At this time, the second elastic members 70 provide a helping force to move the stop member 30 to the third position P3, so that the user may move the release button 50 easily. Once the stop member 30 leaves the fourth position P4, the stop faces 32 of the stop member 30 leaves the end faces 24 of the hooks 20 as well. As a result, the hooks 20 are free to move. At this time, if the user press the contact portions 26 of the hooks 20, the second forces F2 will move the hooks 20 to the second positions P2 from the first positions P1 to disengage the hooking portions 22 from the recesses 42*a* of the tongue plate 42, and therefore the tongue plate 42 of the latch member 40 is able to be pulled out of the chamber 12 of the buckle member 10 through the lateral opening 14. In the present preferred embodiment, the torsional springs 80 further eject the tongue plate 42.

It is noted that the number of the hooks 20, the first elastic members 60, the second elastic members 70, the transmission members 80, and the recesses 42*a* of the tongue plate 42 are two in the safety belt buckle 100 of the present invention, and they are provided in symmetry. However, the number of the above elements may be one, three, fourth, or more, and the locations of the above elements should not be the limitation of the scope of the present invention.

The hooks 20 of the present invention maintain the engagement of the latch member 40 and the buckle member 10, and the latch member 40 disengages the buckle member 10 only when the release button 50 is pushed and the hooks 20 are pressed in sequence, which avoids the latch member 40 from disengaging the buckle member 10 unexpectedly. It must be pointed out that the embodiments described above are only some preferred embodiments of the present invention. All equivalent structures which employ the concepts disclosed in this specification and the appended claims should fall within the scope of the present invention.

What is claimed is:

1. A safety belt buckle, comprising:

a buckle member having a chamber therein and a lateral opening on a side, wherein the lateral opening is communicated with the chamber;

a hook provided in the chamber of the buckle member to be moved between a first position and a second position, wherein the hook stays at the first position under a normal condition, and the hook is moved along a moving trace between the first position and the second position;

a stop member provided in the chamber of the buckle member to be moved between a third position and a fourth position different from the third position, wherein the stop member stays at the third position under the normal condition, and when the stop member is moved to the fourth position, a part of the stop member is on the moving trace of the hook to stop the hook from being moved to the second position from the first position; when the stop member is at the third position, the part of the stop member leaves the moving trace of the hook, so that the hook is movable from the first position to the second position along the moving trace;

a latch member having a tongue plate to be detachably inserted into the chamber of the buckle member through the lateral opening, wherein when the tongue plate enters the chamber of the buckle member, the hook which is at the first position under the normal condition engages the tongue plate to prevent the latch member from disengaging from the buckle member; wherein, when the hook is at the second position, the tongue plate is not engaged by the hook, so that the latch member is detachable from the buckle member;

a release button provided on the buckle member, wherein the release button moves the stop member to the third position from the fourth position when the release button is moved;

wherein, the stop member is in the third position under the normal condition, and is moved to the fourth position by being pushed by the tongue plate when the tongue plate enters the chamber of the buckle member through the lateral opening; the movement of the stop member from the third position to the fourth position is driven by the tongue plate instead of being driven by the hook; when the stop member is in the fourth position, the part of the stop member is on the moving trace of the hook to restrict the hook from being moved from the first position to the second position, so that the tongue plate keeps being engaged by the hook; when the release button is moved to move the stop member from the fourth position to the third position, the part of the stop member leaves the moving trace of the hook, so that the hook is movable from the first position to the second position along the moving trace to stop engaging the tongue plate, whereby the latch member is detachable from the buckle member;

the hook has a hooking portion at an end thereof; the tongue plate of the latch member has a recess; the hooking portion engages the recess when the tongue plate is inserted in the chamber, and the hook is at the first position to secure the tongue plate in the chamber;

the hook has a contact portion opposite to the hooking portion; the contact portion extends out of the buckle member to be pressed to move the hook;

the safety belt buckle further comprises a transmission member, wherein the tongue plate of the latch member moves the stop member to the fourth position from the third position by using the transmission member; and the transmission member has a torsional spring mounted on a post in the chamber of the buckle, and the torsional spring has a first end and a second end, wherein the first end presses against a contact face of the stop member, and the tongue plate of the latch member touches the second end of the torsional spring; the torsional spring is twisted and move the stop member to the fourth position from the third position when the tongue plate of the latch member enters the chamber of the buckle member.

2. The safety belt buckle of claim 1, wherein the stop member has a stop face, and the hook has an end face; the stop face of the stop member is on the moving trace of the hook and touches the end face of the hook when the stop member is moved to the fourth position, and therefore stops the hook from being moved to the second position from the first position.

3. The safety belt buckle of claim 1, wherein the tongue plate of the latch member moves in a direction toward the chamber to move the stop member from the third position to the fourth position in an opposite direction opposite to the direction by using the transmission member.

4. The safety belt buckle of claim 1, further comprising a first elastic member received in the chamber of the buckle member to urge the hook to the first position.

5. The safety belt buckle of claim 1, further comprising a second elastic member received in the chamber of the buckle member to urge the hook to the third position.

* * * * *